US006108820A

United States Patent [19]

Bernhardt

[11] Patent Number: 6,108,820

[45] Date of Patent: Aug. 29, 2000

[54] DOUBLE LAYER SOCK WITH LOW FRICTION LAYER TO LAYER INTERFACE

[76] Inventor: Frederick Bernhardt, 705 Linton Ave., Croydon, Pa. 19021

[21] Appl. No.: 09/255,417

[22] Filed: Feb. 19, 1999

Related U.S. Application Data

[63] Continuation-in-part of application No. 08/893,712, Jul. 11, 1997, Pat. No. 5,918,317.

[51] Int. Cl.[7] ..... A41B 11/00

[52] U.S. Cl. ..... 2/239; 2/409

[58] Field of Search ..... 2/239, 409, 1, 2/46, 69, 243.1, 272, 81, 85, 93, 115, 227, 228, 24; 36/102, 113–116, 11, 9 R, 10, 26, 42, 44

[56] References Cited

U.S. PATENT DOCUMENTS

| | | | |
|---|---|---|---|
| 4,571,960 | 2/1986 | Hursh et al. | 66/196 |
| 4,843,844 | 7/1989 | Hursh et al. | 66/196 |
| 5,399,418 | 3/1995 | Hartmanns et al. | 428/218 |
| 5,575,012 | 11/1996 | Fox et al. | 2/239 |
| 5,590,420 | 1/1997 | Gunn | 2/239 X |
| 5,615,418 | 4/1997 | Pruit | 2/239 |
| 5,675,992 | 10/1997 | Wrightenberry | 66/178 R |
| 5,752,278 | 5/1998 | Gunn | 2/239 |
| 5,829,057 | 11/1998 | Gunn | 2/239 X |
| 5,918,317 | 7/1999 | Berhardt | 2/239 |

*Primary Examiner*—Gloria M. Hale
*Attorney, Agent, or Firm*—LaMorte & Associates

[57] ABSTRACT

A sock and its associated method of manufacture, wherein the sock reduces chafing experienced by the foot. The sock includes an inner sock layer having an interior surface and an exterior surface. The inner sock layer is fabricated from at least one first thread made from a conventional garment material and a second thread made from a fluoropolymer material, wherein the conventional garment material is predominant on the interior surface of the inner sock layer and the fluoropolymer material is predominant on the exterior surface of the inner sock layer. The sock also includes an outer sock layer that surrounds the inner sock layer. The outer sock layer also has an interior surface and an exterior surface. The outer sock layer is fabricated from at least one first thread made from a conventional garment material and a second thread made from a fluoropolymer material, wherein the conventional garment material is predominant on the exterior of the outer sock layer and the fluoropolymer material is predominant on the interior surface of the outer sock layer.

15 Claims, 3 Drawing Sheets

DOUBLE LAYER SOCK WITH LOW FRICTION LAYER TO LAYER INTERFACE

RELATED APPLICATION

This application is a continuation-in-part of U.S. patent application Ser. No. 08/893,712, filed Jul. 11, 1997, U.S. Pat. No. 5,918,317, issue Jul. 6, 1999 entitled, GARMENT AND METHOD FOR PREVENTING CONTACT SORES WITH THE HUMAN BODY.

BACKGROUND OF THE INVENTION

1. Field of the Invention

In general, the present invention relates to structure and the method of manufacture for socks and similar hosiery products. More particularly, the present invention relates to socks and hosiery products that contain more than one layer of material.

2. Prior Art Statement

Many people develop contact sores on their feet. In healthy people, these sores are often caused by poor fitting shoes. As the foot moves in relation to the poor fitting shoe, friction occurs against the skin which produces chaffing of the skin. Without correction, the chaffing can lead to blistering and finally an open sore.

The problem of contact sores on the feet is not always caused by poorly fitting shoes. People afflicted with diabetes or circulatory maladies often have skin that can blister and develop sores from the relatively minor chaffing created within properly fitting shoes and socks.

In an attempt to reduce the occurrence of contact sores, socks have been developed in the prior art that reduce friction and thus chaffing. Such a prior art sock is exemplified in U.S. Pat. No. 5,575,012 to Fox et al., entitled METHOD FOR TREATING LEGWEAR AND PRODUCT. In the Fox patent, a sock is disclosed where the interior of the sock is coated with a fluoropolymer. The presence of the fluoropolymer reduces friction between the skin of the foot and the sock. By reducing friction along this interface, it is believed that the amount of chaffing can be reduced and blisters can be avoided. Such a method is also disclosed in U.S. Pat. No. 5,590,420 to Gunn, entitled LOW FRICTION APPAREL, wherein only specific areas of the interior of a sock contain a low friction material.

A problem associated with coating the interior of a sock with a fluoropolymer is that movement in between the foot and the sock is promoted. The sock therefore moves relative to the foot and does not add any static padding to the foot. Without the static padding of the sock, contact forces are not dispersed against the foot. Certain areas of the foot therefore receive localized forces as the foot moves within the confines of a shoe. Such repeated contact can cause the skin to blister and a sore to develop. Furthermore, if a foot already contains a blister or an open sore, that blister or sore is caused to move past the material of the sock. The movement of the blister or sore relative the sock can open the wound or otherwise aggravate the wound. As a result, although a sock with a slick interior may prevent the formation of some new contact sores, such socks prevent the proper healing of any sores that may develop or that already exist.

A need therefore exists in the prior art for a sock structure that reduces the formation of contact sores, distributes contact forces acting on the foot and does not aggravate or inhibit the healing of existing contact sores. This need is met by the present invention as described and claimed below.

SUMMARY OF THE INVENTION

The present invention is a sock and its associated method of manufacture, wherein the sock reduces chafing experienced by the foot. The sock includes an inner sock layer having a first end, a second end, an interior surface and an exterior surface. The inner sock layer is fabricated from at least one first thread made from a conventional garment material and a second thread made from a fluoropolymer material, wherein the conventional garment material is predominant on the interior surface of the inner sock layer and the fluoropolymer material is predominant on the exterior surface of the inner sock layer.

The sock also includes an outer sock layer that surrounds the inner sock layer. The outer sock layer also has a first end, a second end, an interior surface and an exterior surface. The outer sock layer is fabricated from at least one first thread made from a conventional garment material and a second thread made from a fluoropolymer material, wherein the conventional garment material is predominant on said exterior surface of the outer sock layer and the fluoropolymer material is predominant on the interior surface of the outer sock layer. Accordingly, in the double layer sock, the layer to layer interface embodies a low coefficient of friction that enables the different layers to easily move in relation to each another.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention system can be used in conjunction with liners for prosthetic limbs, the present invention system is especially suitable for use in the manufacture of socks, stockings and similar hosiery products. As a result, the first exemplary embodiment of the present invention system will show the present invention system configured as a sock in order to set forth the best mode contemplated for the invention.

Figure 1:
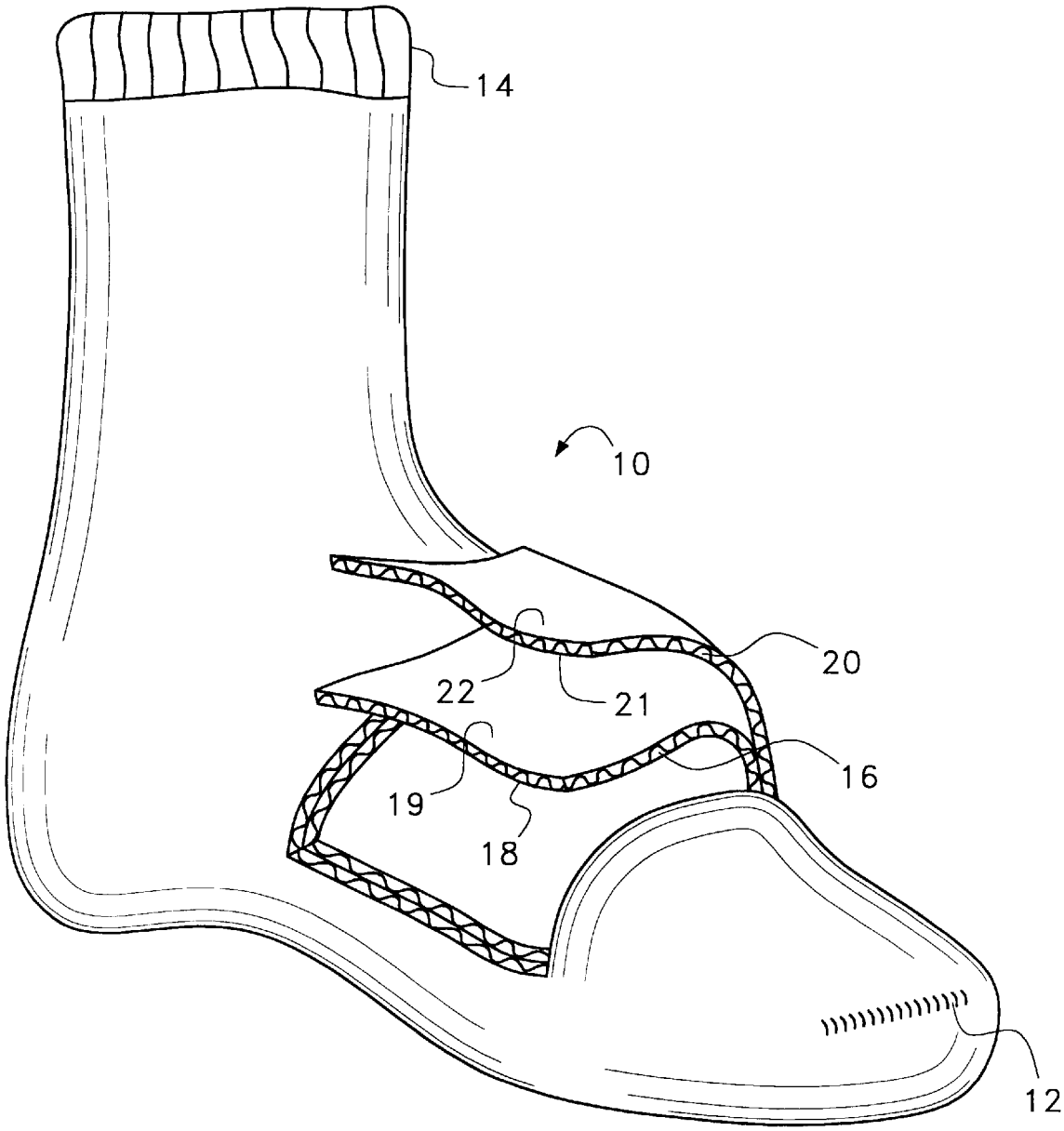
FIG. 1 is a perspective view of a sock in accordance with the present invention.

Referring to FIG. 1, an exemplary embodiment of a sock 10 is shown. The sock 10 is a knit sock having a double layer construction. A double layer construction means that the sock 10 is comprised of two distinct layers of material at all points in the sock except for the toe seam 12 of the sock 10 and the top ankle seam 14 of the sock 10. The method of manufacturing the shown sock 10 is later described in this specification.

The inside sock layer 16 of the sock 10 has an interior surface 18 that contacts the skin of a foot in the sock 10, and an exterior surface 19 that faces the outer sock layer 20 of that sock 10. The outer sock layer 20 has an interior surface 21 that contacts the exterior surface 19 of the inner sock layer 16. The exterior surface 22 of the outer sock layer 20 is the surface of the sock 10 that would contact a shoe worn around the sock 10.

The sock 10 is preferably of a knit manufacture and contains conventional sock thread, such as cotton, acrylic, silk, wool, polyester or the like. The knit of the sock 10 also includes a fluoropolymer thread such as polytetrafluoroethylene, commonly known as Teflon®. The sock 10 is knitted in a manner so that the conventional sock threads are the primary material that contacts the skin of the foot. As will later be described in more detail, the conventional sock threads provide cushioning to the areas of the foot covered by the sock 10. The fluoropolymer thread is configured in the knit pattern so that the fluoropolymer thread is the predominant thread on the exterior surface 19 of the inner sock layer 16 and the interior surface 21 of the outer sock layer 20 of the sock 10. As a result, the interface between the different layers 16, 20 of sock where the exterior surface 19 of the inner sock layer 16 contacts the interior surface 21 of the outer sock layer 20, embodies a low coefficient of friction.

As is later described in detail, the knit pattern of the sock is selected so that the fluoropolymer thread used in the knitting process is the predominant thread on the exterior surface 19 of the inner sock layer 16 and the interior surface 21 of the outer sock layer 20. The use of a fluoropolymer thread in the knit pattern is preferred. However, other methods to create a sock with a fluoropolymer on various surfaces exist. In alternate embodiments, it will be understood that the exterior surface of the inner sock layer and the interior surface of the outer sock layer can be coated with a fluoropolymer material by a spraying or dipping procedure. Such alternate methods of production can be used in practicing the present invention.

Figure 2:
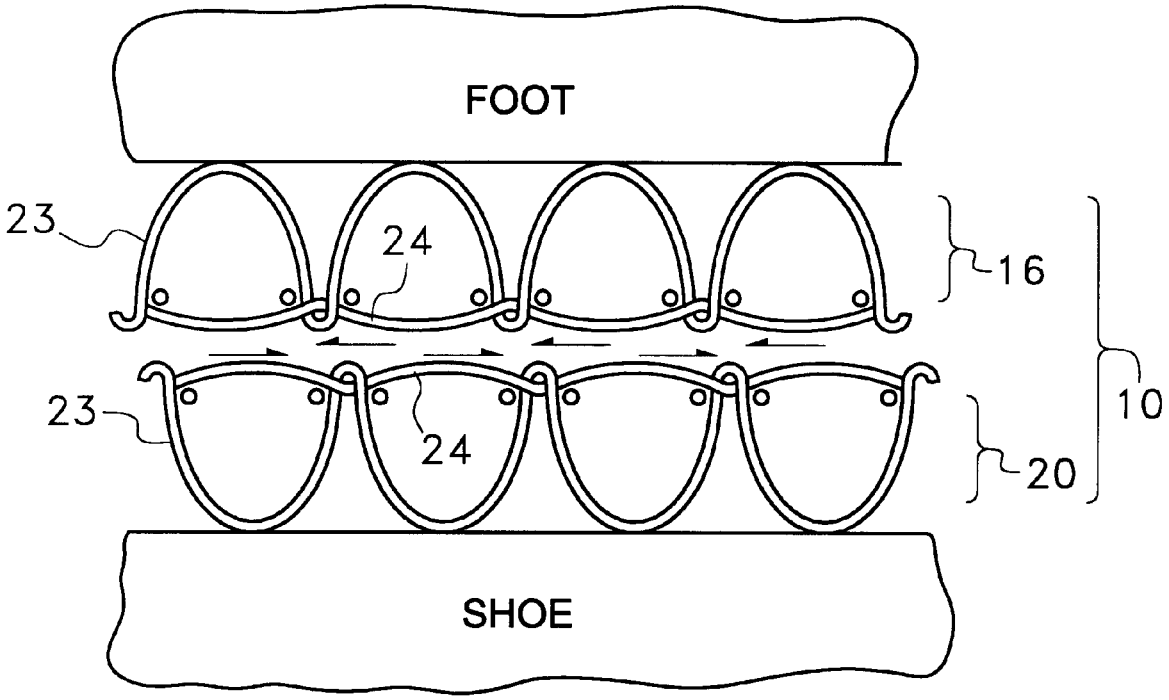
FIG. 2 is a cross-sectional view of a segment of the exemplary sock shown in FIG. 1.

Referring to FIG. 2, it can be seen that the knit pattern of the sock 10 is created so that a large area of knitted loops 22 are created on the interior surface of inner sock layer 16 and the exterior surface of the outer sock layer 20. The large loops 22 in the knit pattern help to cushion the skin of the foot and distribute forces across the skin. The individual large loops 22 conform to the contours of both the foot and the shoe and inhibit movement along these interfaces. As has been previously mentioned, the threads used to create the loops 22 on the interior surface of the inner sock layer 16 and the exterior surface of the outer sock layer 20 are made from conventional materials such as cotton, acrylic, silk, wool, or polyester. Conventional materials are therefore the predominant material on the interior surface of the inner sock layer 16 and the exterior surface of the outer sock layer 20. The knit pattern of the sock 10 also contains a cross thread 24 that is the predominant thread on the exterior surface of the inner sock layer 16 and the interior surface of the outer sock layer 20. It is this cross thread 24 that is made of polytetrafluoroethylene or a similar fluoropolymer. As such, a fluoropolymer is the predominant material on the inner sock layer 16 and the outer sock layer 20 at the interface where these layers contact each another.

As the sock 10 is placed on a person's foot, the material of the sock 10 cushions the foot including any contact sores that may be present on that foot. Since the interior surface of the inner sock layer 16 is made from conventional sock material, the degree of friction in between the sock 10 and the foot is approximately the same as with the use of conventional prior art socks. As the foot and sock 10 are placed within the shoe, the exterior surface of the outer sock layer 20 contacts the shoe. This surface is also made from conventional sock material. Accordingly, the degree of friction between the sock 10 and the foot is approximately the same as with the use of conventional prior art socks.

However, at the interface between the inner sock layer 16 and the outer sock layer 20, both contact surfaces have a low coefficient of friction caused by the predominance of the fluoropolymer thread 24 on these surfaces. The coefficient of friction at the interface between the inner sock layer 16 and the outer sock layer 20 is therefore less than the coefficient of friction between the foot and the sock 10 or the coefficient of friction in between the sock 10 and the shoe. The sock 10 is therefore more likely to move at the interface between the layers 16, 20 in response to any force applied by the foot.

The knit material on the interior surface of the inner sock layer 16 cushions the skin of the foot. The knit material on the exterior surface of the outer layer 20 cushions the sock 10 against the shoe. As such, the interface between the skin of the foot and the interior surface of the inner sock layer 16 remains relatively static. Similarly, the interface between the exterior surface of the outer sock layer 20 and the shoe remains mostly static. Accordingly, no material is moved across the area of the foot that can cause chaffing.

All movement within the shoe is generated along the interface between the inner sock layer 16 and the outer sock layer 20, as is indicated by the shown arrows. This is because the exterior surface of the inner sock layer 16 and the interior surface of the outer sock layer 20 are both manufactured with materials that have a low coefficient of friction. The interface between the inner sock layer 16 and the outer sock layer 20 therefore moves at a lower threshold of force than any of the other interface points.

The low coefficient of friction between the inner sock layer 16 and the outer sock layer 20 reduces the frictional forces experienced by the foot. Furthermore, the presence of the sock 10 around the foot cushions the foot and distributes many of the forces that are experienced by the foot so that those forces are not experienced at a concentrated point on the foot.

Figure 3:
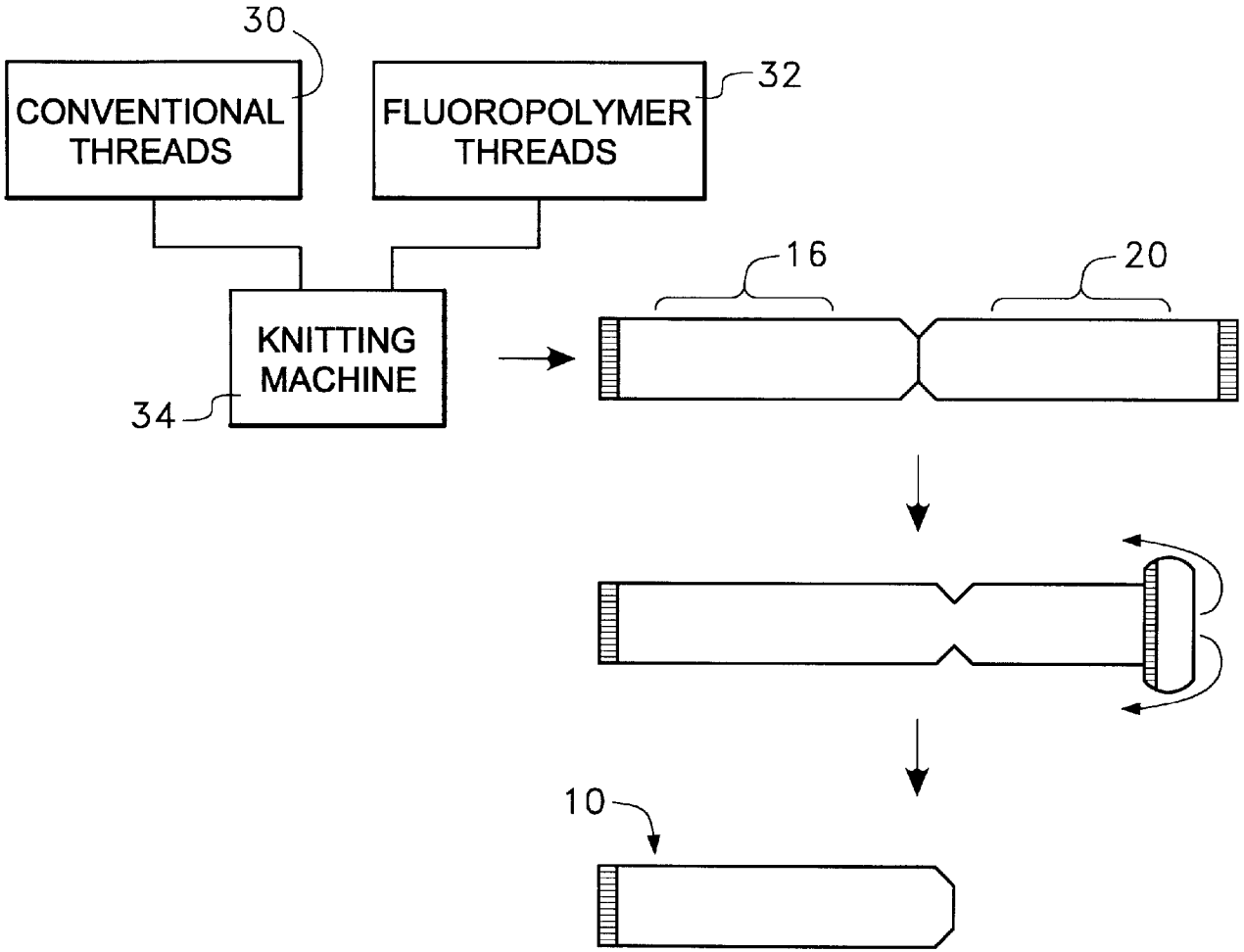
FIG. 3 is a schematic illustrating one method of manufacturing the embodiment of the sock shown in FIG. 1.

Referring to FIG. 3. it can be seen that to manufacture the present invention sock 10, the inner sock layer 16 is first knitted starting at the top of the sock. The threads being used in the knitting include conventional threads 30 and fluoropolymer threads 32. The knitting pattern is arranged so that the fluoropolymer thread 32 is the predominant thread on the exterior surface of the sock. As the inner sock layer 16 is completed, the knitting machine 34 ends the knitting of the inner sock layer 16 at the toe seam and begins knitting the outer sock layer 20, beginning at that same toe seam.

As the outer sock layer 20 of the sock is knitted, the fluoropolymer thread is still predominant on the exterior knitted surface. After the outer sock layer 20 is knit, the sock is invaginated so that the outer sock layer 20 is folded over the inner sock layer 16 of the sock. This brings the low friction surface of the inner sock layer 16 in contact with the low friction surface of the outer sock layer 20. At this point, the free ends of the sock are joined and the sock 10 is complete.

It will be understood that the embodiments of the present invention described and illustrated herein are merely exemplary and a person skilled in the art can make many variations to the embodiment shown without departing from the scope of the present invention. For example, although a knit pattern was illustrated, the present invention can be practiced with woven patterns as well. All such variations, modifications and alternate embodiments are intended to be included within the scope of the present invention as defined by the appended claims.

What is claimed is:

1. A sock, comprising:

an inner sock layer having a first end, a second end, an interior surface and an exterior surface, said inner sock layer being fabricated from at least one first thread made from a conventional garment material and a second thread made from a fluoropolymer material, wherein said conventional garment material is predominant on said interior surface of said inner sock layer and said fluoropolymer material is predominant on said exterior surface of said inner sock layer;

an outer sock layer surrounding said inner sock layer, said outer sock layer having a first end, a second end, an interior surface and an exterior surface, said outer sock layer being fabricated from at least one first thread made from a conventional garment material and a second thread made from a fluoropolymer material, wherein said conventional garment material is predominant on said exterior surface of said outer sock layer and said fluoropolymer material is predominant on said interior surface of said outer sock layer.

2. The sock according to claim 1, wherein said first end of said inner sock layer is affixed to said first end of said outer sock layer.

3. The sock according to claim 2, wherein said second end of said inner sock layer is affixed to said second end of said outer sock layer.

4. The sock according to claim 1, wherein said fluoropolymer material includes polytetrafluoroethylene.

5. The sock according to claim 1, wherein said conventional material is selected from a group consisting of cotton, acrylic, silk, wool and polyester.

6. The sock according to claim 1, wherein said first end of said inner sock layer is integrally knitted to said first end of said outer sock layer.

7. A method of manufacturing a sock, comprising the steps of:

providing an inner sock layer having an exterior surface and an interior surface, wherein said exterior surface is at least partially comprised of a fluoropolymer and has a lower coefficient of friction than said interior surface;

providing an outer sock layer having an exterior surface and an interior surface, wherein said interior surface is at least partially comprised of a fluoropolymer and has a lower coefficient of friction than said exterior surface; and placing said outer sock layer around said inner sock layer so that said exterior surface of said inner sock layer contacts said interior surface of said outer sock layer along a low friction interface.

8. The method according to claim 7, wherein said inner sock layer has a first end and a second end and said outer sock layer has a first end and a second end, said method further including the step of joining said first end of said inner sock layer to said first end of said outer sock layer.

9. The method according to claim 8, further including the step of joining said second end of said inner sock layer to said second end of said outer sock layer.

10. The method according to claim 7, wherein said step of providing said inner sock layer includes fabricating said inner sock layer from at least one first thread made from a conventional garment material and a second thread made from a fluoropolymer material, wherein said conventional garment material is predominant on said interior surface of said inner sock layer and said fluoropolymer material is predominant on said exterior surface of said inner sock layer.

11. The method according to claim 10, wherein said step of providing said outer sock layer, includes fabricating said outer sock layer from at least one first thread made from a conventional garment material and a second thread made from a fluoropolymer material, wherein said conventional garment material is predominant on said exterior surface of said outer sock layer and said fluoropolymer material is predominant on said interior surface of said outer sock layer.

12. The method according to claim 11, wherein said fluoropolymer material includes polytetrafluoroethylene.

13. The method according to claim 12, wherein said conventional material is selected from a group consisting of cotton, acrylic, silk, wool and polyester.

14. The method according to claim 7, wherein said step of providing an inner sock layer and said step of providing an outer sock layer includes knitting said inner sock layer and said outer sock layer as one integral piece.

15. The method according to claim 14, wherein said step of placing said outer sock layer around said inner sock layer includes folding said outer sock layer over said inner sock layer.

* * * * *